US012134956B2

(12) United States Patent
Zhong et al.

(10) Patent No.: US 12,134,956 B2
(45) Date of Patent: Nov. 5, 2024

(54) LINER HANGER SYSTEM

(71) Applicant: Halliburton Energy Services, Inc., Houston, TX (US)

(72) Inventors: Xiaoguang Allan Zhong, Singapore (SG); Yian Zhao, Singapore (SG); Daniel Newton, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/045,618

(22) Filed: Oct. 11, 2022

(65) Prior Publication Data

US 2024/0117716 A1 Apr. 11, 2024

(51) Int. Cl.
*E21B 43/10* (2006.01)
*E21B 33/12* (2006.01)

(52) U.S. Cl.
CPC ..... *E21B 43/103* (2013.01); *E21B 33/1208* (2013.01)

(58) Field of Classification Search
CPC ... E21B 33/1208; E21B 33/129; E21B 43/103
See application file for complete search history.

(56) References Cited

U.S. PATENT DOCUMENTS

| | | | |
|---|---|---|---|
| 4,663,513 | A | 5/1987 | Webber |
| 4,832,125 | A | 5/1989 | Taylor |
| 4,919,460 | A | 4/1990 | Milberger |
| 5,303,518 | A | 4/1994 | Strickland |
| 6,029,748 | A | 2/2000 | Forsyth et al. |
| 6,098,717 | A | 8/2000 | Bailey et al. |
| 6,378,606 | B1 | 4/2002 | Swor |
| 7,360,592 | B2 | 4/2008 | McMahan |
| 9,580,981 | B2 | 2/2017 | Zhong et al. |
| 10,337,298 | B2 | 7/2019 | Braddick |

(Continued)

FOREIGN PATENT DOCUMENTS

| | | |
|---|---|---|
| EP | 0289108 | 3/1992 |
| WO | 2011151139 | 12/2011 |

(Continued)

OTHER PUBLICATIONS

Designer's Guide: Outside Surfaces-Undercuts, Precision Machined Products Association, pp. 2-3; Accessed Jul. 26, 2024.*

(Continued)

*Primary Examiner* — Tara Schimpf
*Assistant Examiner* — Lamia Quaim
(74) *Attorney, Agent, or Firm* — K&L Gates LLP

(57) ABSTRACT

A liner hanger system for use in a subterranean well is disclosed. The liner hanger system comprises a well casing and a liner hanger. The liner hanger comprises a spike extending in an annular ring around an outer perimeter of the liner hanger. The spike comprises an annular groove defined therein. The liner hanger further comprises an annular seal positioned at least partially within the annular groove. The liner hanger is expandable to transition between an initial state where the spike is not in contact with the well casing and an expanded state where the spike is in contact with the well casing. The spike and the annular seal are configured to seal an uphole well portion from a downhole well portion when the liner hanger is in the expanded state.

22 Claims, 5 Drawing Sheets

(56) References Cited

U.S. PATENT DOCUMENTS

| | | | | |
|---|---|---|---|---|
| 11,215,012 | B2 | 1/2022 | Chen et al. | |
| 11,225,000 | B2 * | 1/2022 | Yu | B29C 44/186 |
| 11,248,450 | B2 | 2/2022 | Hazelip | |
| 11,248,451 | B2 | 2/2022 | Sevadjian et al. | |
| 2001/0045289 | A1 | 11/2001 | Cook et al. | |
| 2001/0047866 | A1 | 12/2001 | Cook et al. | |
| 2002/0014339 | A1 | 2/2002 | Ross | |
| 2002/0139540 | A1 | 10/2002 | Lauritzen | |
| 2003/0042022 | A1 | 3/2003 | Lauritzen | |
| 2003/0047322 | A1 | 3/2003 | Maguire et al. | |
| 2003/0094768 | A1 | 5/2003 | Kamiya et al. | |
| 2004/0149418 | A1 | 8/2004 | Bosma et al. | |
| 2004/0244994 | A1 | 12/2004 | Jackson | |
| 2005/0011650 | A1 | 1/2005 | Harrall et al. | |
| 2005/0052019 | A1 | 3/2005 | Schroeder | |
| 2007/0257486 | A1 | 11/2007 | Filippov et al. | |
| 2012/0205091 | A1 | 8/2012 | Turley et al. | |
| 2012/0312542 | A1 | 12/2012 | Varghese | |
| 2013/0248209 | A1 | 9/2013 | Watson | |
| 2014/0020911 | A1 | 1/2014 | Martinez | |
| 2014/0174763 | A1 | 6/2014 | Zhong et al. | |
| 2015/0011650 | A1 | 1/2015 | Bartos et al. | |
| 2015/0068733 | A1 | 3/2015 | Dilber | |
| 2016/0053591 | A1 | 2/2016 | Hallundbæk et al. | |
| 2016/0326830 | A1 | 11/2016 | Hallundbæk et al. | |
| 2016/0356131 | A1 | 12/2016 | Humphrey et al. | |
| 2017/0022775 | A1 | 1/2017 | Spitz et al. | |
| 2018/0045016 | A1 | 2/2018 | Radtke et al. | |
| 2018/0112486 | A1 | 4/2018 | Potts | |
| 2018/0135369 | A1 | 5/2018 | Parekh | |
| 2019/0316434 | A1 | 10/2019 | Davies | |
| 2019/0330943 | A1 * | 10/2019 | Givens | E21B 23/01 |
| 2020/0173248 | A1 | 6/2020 | Yee et al. | |
| 2021/0011576 | A1 | 1/2021 | Suto et al. | |
| 2021/0020263 | A1 | 1/2021 | Pasini et al. | |
| 2021/0087902 | A1 | 3/2021 | Saeed | |
| 2021/0115764 | A1 | 4/2021 | Zhong et al. | |
| 2022/0145712 | A1 | 5/2022 | Bermudez et al. | |
| 2023/0003097 | A1 * | 1/2023 | Vasques | E21B 33/122 |
| 2023/0374890 | A1 | 11/2023 | Zhong et al. | |
| 2023/0407730 | A1 | 12/2023 | Zhong et al. | |
| 2024/0117716 | A1 | 4/2024 | Zhong et al. | |

FOREIGN PATENT DOCUMENTS

| | | |
|---|---|---|
| WO | 2020185208 | 9/2020 |
| WO | 2022177939 A1 | 8/2022 |

OTHER PUBLICATIONS

International Search Report and Written Opinion dated Jul. 11, 2023 for corresponding PCT Patent Application No. PCT/US2022/077934 filed on Oct. 12, 2022.

Zhong, Allan et al, "Performance Evaluation of a Large Bore Expandable Liner Hanger for Field Operations in the Gulf of Mexico", Paper OTC-25995-MS presented at Offshore Technology Conference, Mar. 7, 2015, 12 pgs, Houston, Texas, USA.

"PCT Application No. PCT/US2023/070087, International Search Report and Written Opinion", Apr. 2, 2024, 12 pages.

U.S. Appl. No. 17/750,807 Final Office Action, May 28, 2024, 29 pages.

"PCT Application No. PCT/US2022/077934 International Search Report and Written Opinion", Jul. 11, 2023, 13 pages.

"PCT Application No. PCT/US2023/086224 International Search Report and Written Opinion", May 8, 2024, 8 pages.

"U.S. Appl. No. 17/750,662 Final Office Action", Apr. 25, 2024, 9 pages.

"U.S. Appl. No. 18/045,618 Office Action", Nov. 28, 2023, 15 pages.

* cited by examiner

LINER HANGER SYSTEM

BACKGROUND

The present disclosure relates generally to equipment utilized and operations performed in conjunction with a subterranean well and, more particularly, to an improved liner hanger system.

During wellbore operations, it is typical to "hang" a liner onto another section of casing above such that the liner is supported by the casing from which the liner is hung. Expandable liner hangers may generally be used to secure the liner within a previously set wellbore tubular (e.g., casing or liner string). Expandable liner hangers may be "set" by expanding the liner hanger radially outward into gripping and sealing contact with the wellbore tubular. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

The expansion process may typically be performed by means of a setting tool used to convey the liner hanger into the wellbore. The setting tool may be interconnected between a work string (e.g., a tubular string made up of drill pipe or other segmented or continuous tubular elements) and the liner hanger. The setting tool may expand the liner hanger into anchoring and sealing engagement with the casing. In certain instances, when the liner hanger is expanded, a proper seal may not form between the liner hanger and the casing when high pressure and/or large temperature swings are present in the well.

BRIEF DESCRIPTION OF THE DRAWINGS

Embodiments of the Liner Hanger System are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
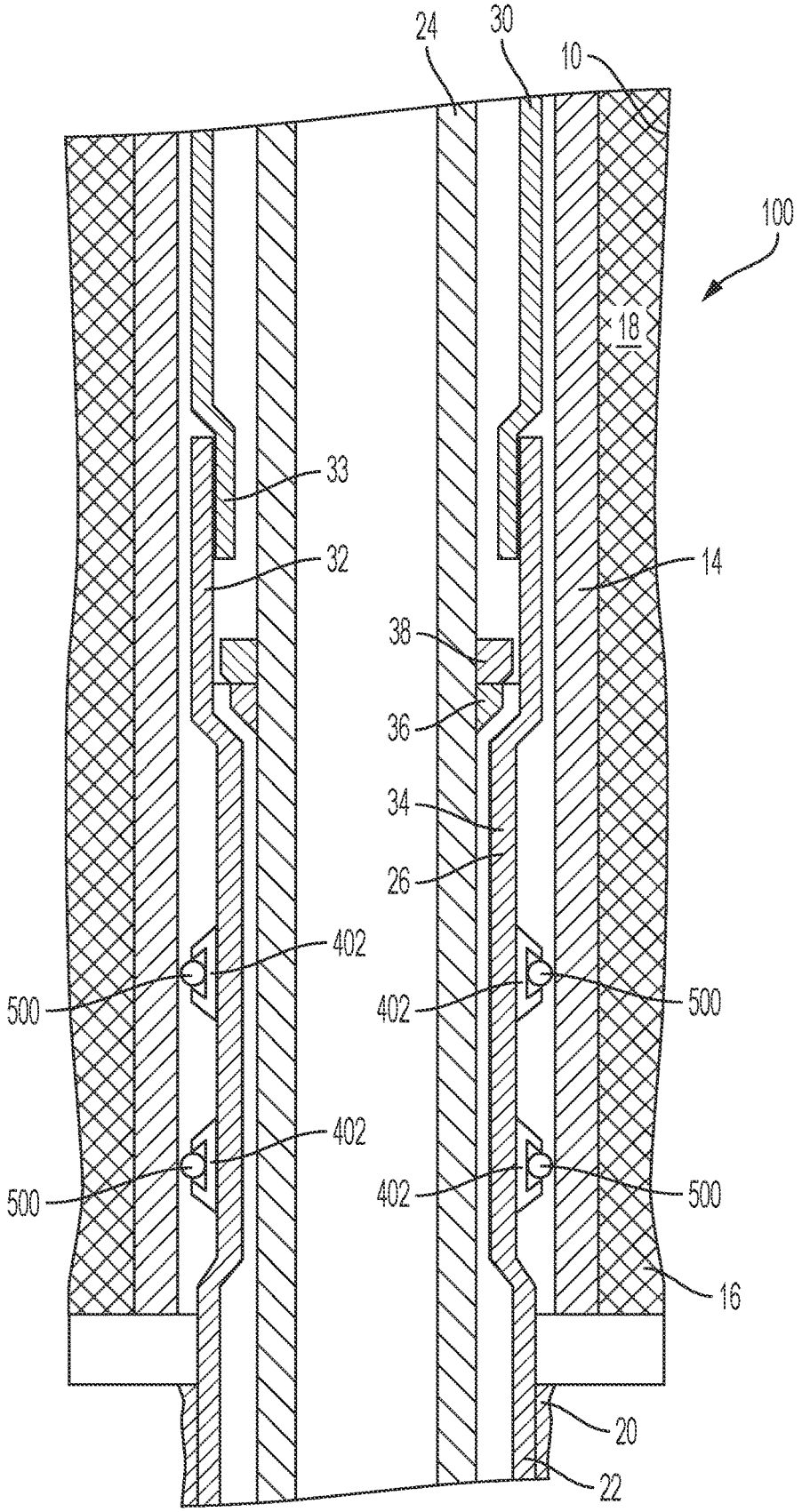
FIG. 1 is a cross-sectional view of a liner hanger system in accordance with an illustrative embodiment of the present disclosure.

The present disclosure relates generally to equipment utilized and operations performed in conjunction with a subterranean well and, more particularly, to an improved expandable liner hanger system over existing designs.

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations. Certain embodiments according to the present disclosure may provide for a single trip liner setting and drilling assembly.

The terms "couple" or "couples" as used herein are intended to mean either an indirect or a direct connection. Thus, if a first device couples to a second device, that connection may be through a direct connection, or through an indirect electrical or mechanical connection via other devices and connections. The term "wellbore" as used herein refers to any hole drilled into a formation for the purpose of exploration or extraction of natural resources such as, for example, hydrocarbons. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons. Embodiments may be applicable to injection wells as well as production wells, including hydrocarbon wells.

FIG. 1 depicts an expandable liner hanger system 100 including an expandable liner hanger 26 in accordance with one embodiment of the present disclosure. The liner hanger 26 is configured for use in a system for performing operations in a subterranean well. As shown in FIG. 1, a wellbore 10 may be drilled through earth formation 12. A casing 14 may then be placed in an upper portion 16 of the well 10 and held in place by cement 18 which is injected between the casing 14 and the upper portion 16 of well 10.

Below casing 14, a lower portion 20 of the wellbore 10 may be drilled through casing 14. The lower portion 20 may have a smaller diameter than the upper portion 16. A length of liner 22 is shown positioned within the lower portion 20. The liner 22 may be used to line or case the lower portion 20 and/or to drill the lower portion 20. If desired, cement may be placed between the liner 22 and lower portion 20 of wellbore 10. The liner 22 may be installed in the wellbore 10 by means of a work string 24. The work string 24 may include a releasable collet, not shown, by which the work string 24 can support and rotate the liner 22 as the liner 22 is placed in the wellbore 10.

Attached to the upper end of, or formed as an integral part of, liner 22 is the liner hanger 26. A polished bore receptacle, or tie back receptacle, 30 may be coupled to the upper end of the liner hanger 26. In one embodiment, the polished bore receptacle 30 may be coupled to the liner hanger 26 by a threaded joint 32, but in other embodiments a different coupling mechanism may be employed. The inner bore of the polished bore receptacle 30 may be smooth and machined to close tolerance to permit work strings, production tubing, etc. to be connected to the liner 22 in a fluid-tight and pressure-tight manner. For instance, a work string may be connected by means of the polished bore receptacle 30 and used to pump fracturing fluid at high pressure down to the lower portion 20 of the wellbore 10 without exposing the casing 14 to the fracturing pressure. It may be desirable for the outer diameter of liner 22 to be as large as possible while being able to lower the liner 22 through the casing 14. It also may be desirable to have the outer diameter of the polished bore receptacle 30 and the liner hanger 26 to be about the same as the diameter of liner 22.

In various embodiments, first and second expansion cones 36 and 38 may be carried on the work string 24 just above the reduced diameter body 34 of the liner hanger 26. Fluid pressure applied between the work string 24 and the liner hanger 26 may be used to drive the cones 36, 38 downward through the liner hanger 26 to expand the hanger body 34 to an outer diameter at which a portion, or portions, of the liner hanger 26 is forced into sealing and supporting contact with the casing 14, as further described herein. The first expansion cone 36 may be a solid, or fixed diameter, cone having an outer diameter smaller than the inner diameter 33 of the threaded joint 32. In the run in condition, second expansion cone 38 may have an outer diameter greater than first cone 36 and also greater than the inner diameter 33 of the threaded joint 32. In an embodiment, the second expansion cone 38 may be collapsible, that is, may be reduced in diameter smaller than the inner diameter 33 of the threaded joint 32 when the second expansion cone 38 needs to be withdrawn from the liner hanger 26. In some contexts, the second expansion cone 38 may be referred to as a collapsible expansion cone. After the liner hanger 26 is expanded, expansion cones 36, 38 may be withdrawn from the liner hanger 26, through the polished bore receptacle 30 and out of the wellbore 10 with the work string 24. In the illustrated embodiment, expansion cones 36, 38 are utilized to expand the liner hanger 26 from an initial state to an expanded state. Further, expandable liner hangers, such as liner hanger 26 may be expanded by use of hydraulic pressure to drive an expanding cone, wedge, or "pig," through the liner hanger. Other embodiments are envisioned which utilize any number of techniques, or combinations thereof, to expand the liner hanger 26 such as mechanical swaging, explosive expansion, memory metal expansion, swellable material expansion, electromagnetic force-driven expansion, etc.

Referring primarily to FIG. 1, the liner hanger 26 comprises annular anchoring ridges or spikes 402. The spikes 402 may be metal spikes and may be made of any suitable steel grade, alloy steel, aluminum, any other ductile material, and a combination thereof. In certain implementations, the spikes 402 may be made from a combination of one or more of the recited materials. In certain embodiments, the spikes 402 are integral to the liner hanger 26, however other embodiments are envisioned where the spikes 402 are attached to the outer perimeter of the liner hanger 26 via welding or any other suitable method. In certain embodiments, the spikes 402 may be made from AISI4140 steel or AISI4340 steel. In certain implementations, each spike 402 may be an annular or circular ring that extends around an outer perimeter of the liner hanger 26 at a desired axial location or locations. However, the present disclosure is not limited to this particular configuration of spikes 402. For instance, in certain embodiments, the spikes 402 may extend along an axial direction of the liner hanger 26. Moreover, in certain implementations, the different spikes 402 may have different surface geometries without departing from the scope of the present disclosure. In the illustrated embodiment, a first spike 402 extends along an outer perimeter of the liner hanger 26 at a first axial position along the liner hanger 26 and a second spike 402 extends along an outer perimeter of the liner hanger 26 at a second axial position along the liner hanger 26. Other embodiments are envisioned with any number of spikes 402 positioned axially along the liner hanger 26.

Figure 2:
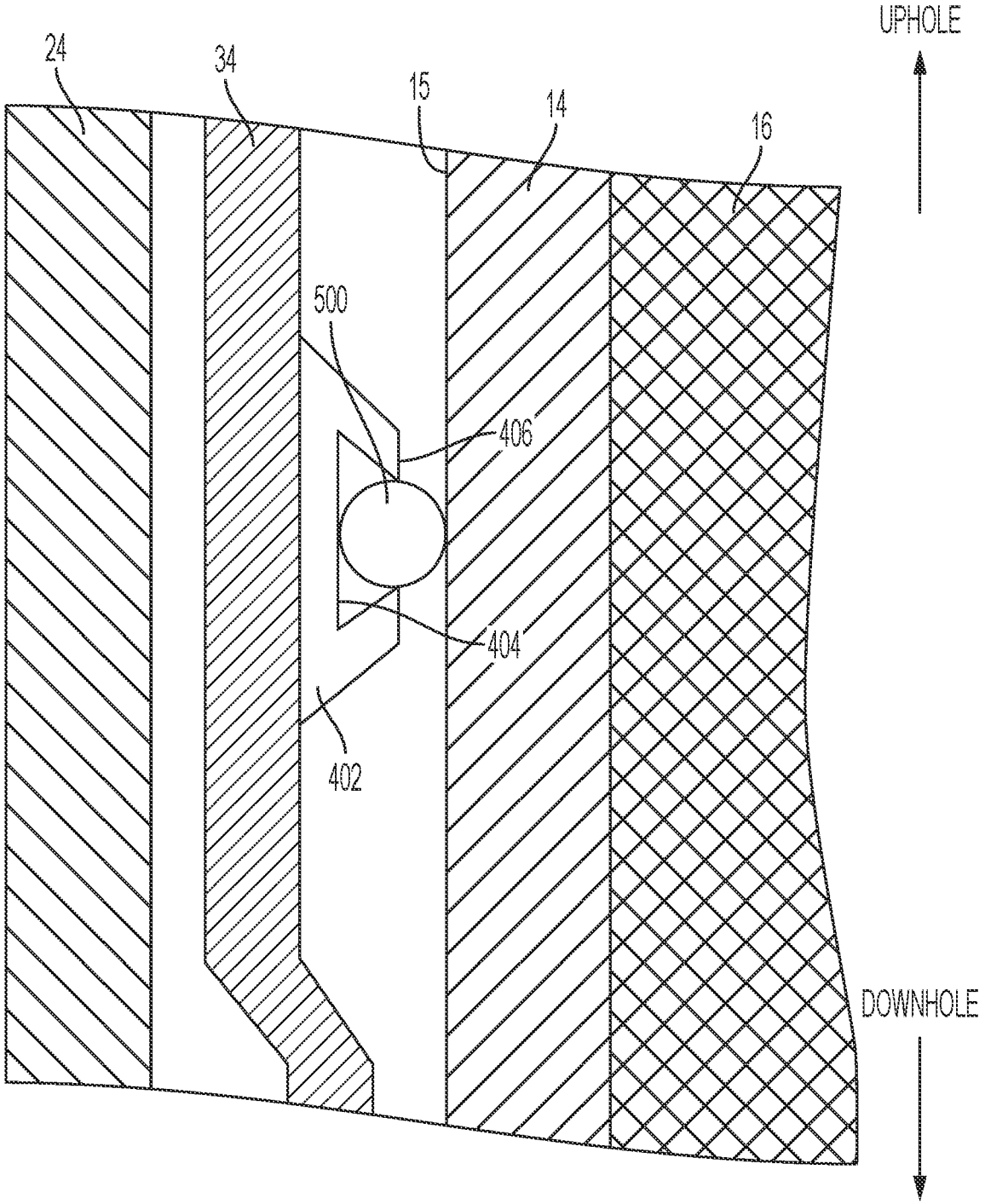
FIG. 2 is an enlarged cross-section view of the liner hanger system of FIG. 1.

Referring primarily to FIG. 2, an enlarged view of one of the spikes 402 of the system of FIG. 1 is illustrated. The spike 402 comprises an annular cavity, or annular groove 404 defined therein. In the illustrated embodiment the annular groove 404 comprises a dovetail shape. However, other embodiments are envisioned where the annular groove 404 defines a different shape such as a square, rectangle, a hexagon, a polygon, and/or any other geometric shape, for example. In at least one embodiment, the annular groove 404 comprises a profile that includes both arcuate and flat portions, for example.

The system illustrated in FIG. 1 further comprises an annular seal 500 positioned at least partially within the annular groove 404. The seal 500 is positioned intermediate the spike 402 and the well casing 14. In the illustrated embodiment, the seal 500 comprises a circular cross-section. However, other embodiments are envisioned where the seal 500 comprises a different cross-section shape such as a square, a rectangle, a hexagon, a polygon, and/or any other geometric shape, for example. In at least one embodiment, the cross-sectional shape of the seal 500 includes arcuate portions and/or flat portions. For example, in at least one embodiment, the seal 500 comprises a substantially polygonal cross-section with rounded corners and flat sides.

In at least one embodiment, the seal 500 comprises an elastomer such as Hydrogenated Nitrile Butadiene Rubber, i.e., HNBR or VITON®, and/or combinations thereof. Other embodiments are envisioned where the seal comprises rubber, plastic, TEFLON®, i.e., PTFE (Polytetrafluoroethylene), etc., and combinations thereof. In at least one embodiment, the seal 500 comprises a composite or metamaterial. In such instance, the metamaterial may have a negative thermal expansion coefficient or the thermal expansion coefficient can be zero. In at least one embodiment, the seal 500 comprises a metamaterial having a thermal expansion coefficient that is the same or substantially the same as the thermal expansion coefficient of the spike 402. In at least one embodiment, the seal 500 may be constructed from molding for rubber or injection molding for plastics, and combinations thereof (Inventors to provide materials from U.S. Patent Application Publication No. 2021/0020263). In at least one embodiment, the seal 500 comprises a metamaterial having a lattice structure. For example, the seal 500 may be constructed from metals and rubber or thermoplastics and rubber. In such instances, a metal and/or plastic lattice structure is produced from additive manufacturing, and the rubber is used to encapsulate the lattice structure to form the seal. In at least one embodiment, the lattice structure is constructed of 4140 Steel, type 316 steel, PTFE, PEEK (Polyetheretherketone), etc, and combinations thereof. In at least one embodiment, the lattice structure is constructed of an aluminum alloy, or a titanium aluminum alloy, or a titanium-aluminum-vanadium alloy, etc., and combinations thereof. In at least one embodiment, the lattice is constructed of the same type of material but different portions of the structure have different coefficients of thermal expansion due to the shape of the lattice structure. In at least one embodiment, the seal 500 comprises a single naturally occurring material, i.e., a non-metamaterial. Further, the seal 500 may be constructed of rubber, thermoplastics, and combinations thereof. In at least one embodiment, the seal 500 comprises rubber having fillers with different material properties.

In at least one embodiment, the seal 500 comprises a squeeze (i.e., the percentage of deformation to the seal from its initial shape to its deformed shape) of 20% to 50%. However, other embodiments are envisioned where the squeeze of the seal 500 is any suitable percentage. In at least one embodiment, the seal 500 comprises a metamaterial having a squeeze of 5% to 10% for example. In at least one embodiment, the seal 500 comprises substantially the same cross-sectional area as the cross-sectional area of the annular groove 404. In at least one embodiment, the cross-sectional area of the annular seal 500 is slightly smaller than the cross-sectional area of the annular groove 404 by 1% to 5%, for example. Other embodiments are envisioned where the cross-sectional area of the annular seal 500 is slightly larger than the cross-sectional area of the annular groove 404, for example.

In the illustrated embodiment, two annular spikes 402 and two annular seals 500 are shown spaced apart axially within the casing 14. It should be readily understood that any number of spikes 402 and seals 500 may be incorporated into the system and the illustrated embodiments should not be considered limiting.

Figure 3:
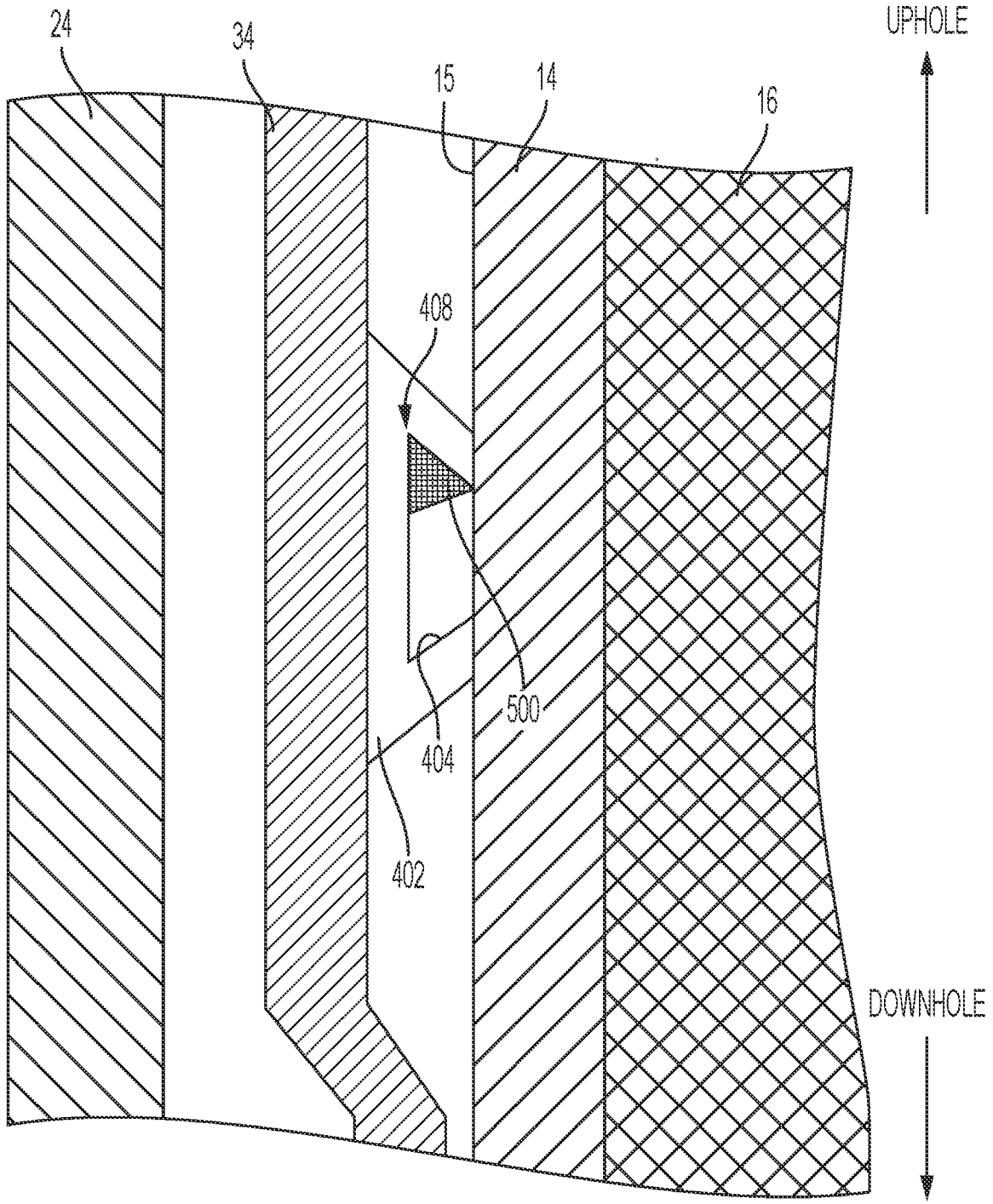
FIG. 3 is an enlarged cross-section view of the liner hanger system of FIG. 1 in an expanded state.

Further to the above, the liner hanger 26 is configured to transition between an initial run in state, where one or more spikes 402 are not in contact with the casing 14 and an expanded state where the outer diameter of the liner hanger 26 has been expanded such that one or more spikes 402 are in gripping and sealing contact with the casing 14. FIGS. 1 and 2 illustrate the liner hanger 26 in the initial state and FIG. 3 illustrates the liner hanger 26 in the expanded state. The liner hanger 26 may be expanded using any suitable means, as described herein. In the illustrated embodiment, when the liner hanger 26 is in an initial state, the annular seal 500 extends beyond an outer surface 406 of the spike 402. As such, when the liner hanger 26 is expanded, the seal 500 engages an inner wall 15 of the casing 14 and the inner wall 15 compresses the seal 500 into a portion of the annular groove 404. Other embodiments are envisioned where the annular seal 500 does not extend beyond the outer surface 406 of the spike 402 when the liner hanger 26 is in the initial state. In such instances, the seal 500 may still engage the inner wall 15 of the casing 14 when the liner hanger 26 is in the expanded state due to the deformation of the casing 14 by the spike 402.

Further to the above, the annular seal 500 and the spike 402 are configured to seal an uphole well portion from a downhole well portion when the liner hanger 26 is in its expanded state. In various embodiments, the spike 402 may deform a portion of the well casing 14 when the liner hanger 26 is in the expanded state to connect the liner hanger 26 to the casing 14. In various embodiments, the seal 500 is compressed by the inner wall 15 of the casing 14 and fills a portion of the annular groove 404 of the spike 402 to aid in sealing the uphole well portion from the downhole well portion. After the liner hanger 26 is expanded, the system may be pressurized such that there is a pressure differential between the uphole side and downhole side of a given spike 402, for example. In such instances, the pressure differential may further deform and/or compress the seal 500 within the annular groove 404, for example. In at least one embodiment, when the liner hanger 26 is expanded and the system is under pressure, the seal 500 is compressed and fills an undercut region 408 of the annular groove 404 as illustrated in FIG. 3.

Figure 4:
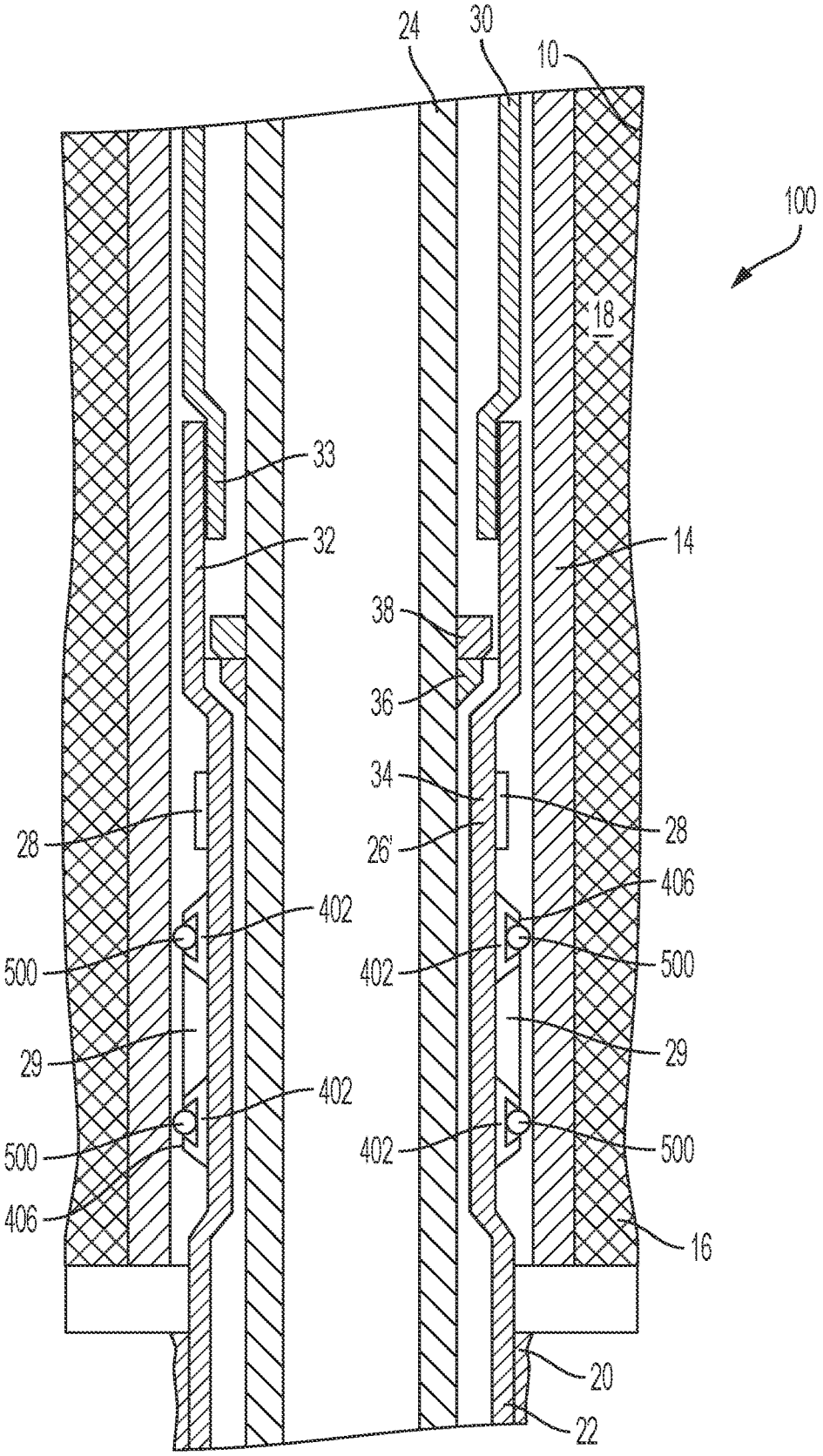
FIG. 4 is a cross-sectional view of a liner hanger system in accordance with an illustrative embodiment of the present disclosure.

FIG. 4 illustrates another liner hanger 26' that is similar in many respects to liner hanger 26 except for the differences discussed herein. Liner hanger 26' comprises the annular spike 402 axially spaced apart and a seal 28 positioned above (i.e., uphole) the spike 402. The seal 28 may be attached to the liner hanger 26' using any suitable means or formed as an integral part of the liner hanger 26'. In the illustrated embodiment one annular seal 28 is shown, however other embodiments are envisioned with more than one annular seals, for example. Further, other embodiments are envisioned with one or more seals positioned below (i.e., downhole) the spike 402, for example. When the liner hanger 26' is expanded, the seals 28 are forced into sealing and supporting contact with the casing 14.

Further to the above, the liner hanger 26' comprises another annular seal 29 positioned intermediate the upper spike 402 and the lower spike 402. In the illustrated embodiment, the annular seal 29 fills the region between the spikes 402 and is flush with the outer surface 406 of each spike 402. However, other embodiments are envisioned where the seal 29 has an outer diameter that is smaller than the outer diameter of the spikes 402, for example. Further still, other embodiments are envisioned where the seal 29 has an outer diameter that is larger than the outer diameter of the spikes 402, i.e., the seal 29 extends beyond the outer surface 406 of the spikes 402. Further, other embodiments are envisioned where the seal 29 does not extend entirely between the upper spike 402 and the lower spike 402. In the illustrated embodiment, the seal 29 comprises a trapezoid cross-section. However other embodiments are envisioned where the seal 29 comprises a different cross-section shape such as a square, a rectangle, a hexagon, a polygon, and/or any other geometric shape, for example. In at least one embodiment, the cross-sectional shape of the seal 29 includes arcuate portions and/or flat portions. In any event, when the liner hanger 26' is expanded, the seal 29 is forced into sealing and supporting contact with the casing 14.

Typically, seals 28, 29 are made of elastomeric elements (e.g., rubber) however other embodiments are envisioned where the seals 28, 29 are comprised of other materials such as metamaterials, materials having a negative or zero coefficient of thermal expansion, etc. In various embodiments the seals 28, 29 may comprises the same material as the annular seal 500, for example. Other embodiments are envisioned where the seals 28, 29 comprise a different material than the seal 500, for example.

Figure 5:
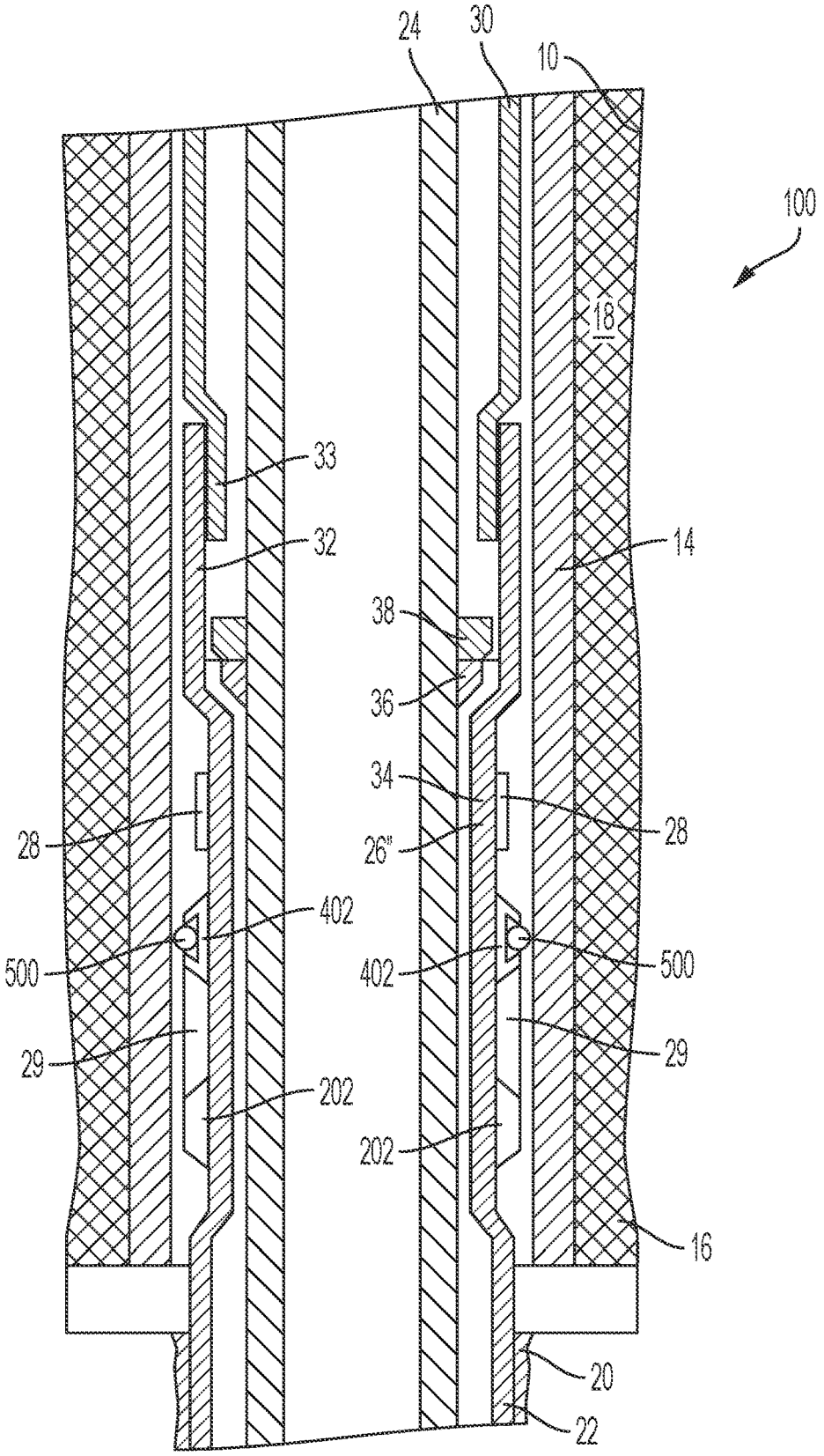
FIG. 5 is a cross-sectional view of a liner hanger system in accordance with an illustrative embodiment of the present disclosure.

FIG. 5 illustrates another liner hanger 26" that is similar in many respects to liner hanger 26 and 26' except for the differences discussed herein. Liner hanger 26" comprises an annular spike 402, the seal 28 positioned above (i.e., uphole) the spike 402, and another annular spike 202 positioned below (i.e., downhole) the annular spike 402. In the illustrated embodiment one annular seal 28 is shown, however other embodiments are envisioned with one or more annular seals, for example. Further, other embodiments are envisioned with one or more seals 28 positioned below (i.e., downhole) the spikes 202, 402, for example. In the illustrated embodiment, the annular seal 29 discussed above is positioned intermediate the annular spike 402 and the annular spike 202. As discussed above, when the liner hanger 26" is expanded, the seals 28, 29 are forced into sealing and supporting contact with the casing 14.

Further to the above, the annular spike 202 comprises a flat outer surface which, similar to the spike 402, is configured to provide gripping and sealing contact with the casing 14 when the liner hanger 26" is expanded. In the illustrated embodiment, the spike 202 comprises a trapezoid cross-section. However, other embodiments are envisioned where the spike 202 comprises a different cross-section such as a square, a triangular, a rectangle, a hexagon, a polygon, and/or any other geometric shape, for example. In at least one embodiment, the cross-sectional shape of the spike 202 includes arcuate portions and/or flat portions.

Further to the above, the spike 202 may be metal. The spike 202 may be made of any suitable steel grade, alloy steel, aluminum, any other ductile material, and a combination thereof. In certain implementations, the spike 202 may be made from a combination of one or more of the recited materials. In certain embodiments, the spike 202 is integral to the liner hanger 26", however other embodiments are envisioned where the spike 202 is attached to the outer perimeter of the liner hanger 26" via welding or any other suitable method. In certain embodiments, the spike 202 may be made from AISI4140 steel or AISI4340 steel. In certain implementations, the spike 202 may be an annular or circular ring that extends along an outer perimeter of the liner hanger 26" at a desired axial location. However, the present disclosure is not limited to this particular configuration of spike 202. For instance, in certain embodiments, one or more spikes 202 may be positioned axially around an outer perimeter of the liner hanger 26". Moreover, in certain implementations, different spikes 202 may have different surface geometries without departing from the scope of the present disclosure.

Further to the above, it should be understood that any number of the spikes 402 including seals 500, the spikes 202, and the seals 28, 29 may be incorporated into the system and the illustrated embodiments should not be considered limiting. In at least one embodiment, one of the spikes 402 including the seal 500 is positioned above one or more spikes 202, similar to FIG. 5. Further, in such instances, another of the spikes 402 is positioned downhole of the one or more spikes 202. In other words, the spikes 402 are positioned at the most downhole (i.e., most distal) and most uphole (i.e., the most proximal) locations along the liner hanger. In at least one embodiment, any number of seals 28, 29 may be positioned intermediate, above, and/or below the spikes 202, 402, for example.

Although the figures depict embodiments of the present disclosure in a particular orientation, it should be understood by those skilled in the art that embodiments of the present disclosure are well suited for use in a variety of orientations. Further, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

Examples of the above embodiments include:

Example 1 is a liner hanger system for use in a subterranean well. The liner hanger system comprises a well casing and a liner hanger. The liner hanger comprises a spike extending in an annular ring around an outer perimeter of the liner hanger. The spike comprises an annular groove defined therein. The liner hanger further comprises an annular seal positioned at least partially within the annular groove. The liner hanger is expandable to transition between an initial state where the spike is not in contact with the well casing and an expanded state where the spike is in contact with the well casing. The spike and the annular seal are configured to seal an uphole well portion from a downhole well portion when the liner hanger is in the expanded state.

In Example 2, the embodiments of any preceding paragraph or combination thereof further include the annular seal comprises a polygonal cross-section In Example 3, the embodiments of any preceding paragraph or combination thereof further include the annular seal comprises a substantially circular cross-section.

In Example 4, the embodiments of any preceding paragraph or combination thereof further include the annular seal comprises a metamaterial.

In Example 5, the embodiments of any preceding paragraph or combination thereof further include the annular seal comprises a encapsulated lattice structure.

In Example 6, the embodiments of any preceding paragraph or combination thereof further include the annular seal comprises a material having a negative or zero coefficient of thermal expansion.

In Example 7, the embodiments of any preceding paragraph or combination thereof further include the annular seal is at least partially compressed by an inner wall of the well casing when the liner hanger is in the expanded state.

In Example 8, the embodiments of any preceding paragraph or combination thereof further include the annular seal extends beyond an outer surface of the spike when the liner hanger is in the initial state.

In Example 9, the embodiments of any preceding paragraph or combination thereof further include the annular groove comprises a dovetail shape.

In Example 10, the embodiments of any preceding paragraph or combination thereof further include the liner hanger comprises another annular seal extending in an annular ring around the outer perimeter of the liner hanger adjacent to the spike.

In Example 11, the embodiments of any preceding paragraph or combination thereof further include the spike comprises a first spike. The liner hanger further comprises a second spike adjacent the first spike. The second spike comprises a continuously flat outer surface configured to contact the well casing when the liner hanger is in the expanded state.

In Example 12, the embodiments of any preceding paragraph or combination thereof further include the annular seal is compressed and fills a portion of the annular groove when a pressure differential is present across the uphole well portion and the downhole well portion.

Example 13 is an expandable liner hanger for use with a well casing in a subterranean well. The expandable liner hanger comprises a spike extending in an annular ring along an outer perimeter of the expandable liner hanger. The spike comprises an annular groove defined therein. The liner hanger further comprises an annular seal positioned within at least a portion of the annular groove of the spike. The spike is configured to grippingly engage an inner wall of the well casing when the expandable liner hanger is in an expanded state. The annular seal is configured to be compressed to fill a portion of the annular groove when a pressure differential is present across an uphole well side and a downhole well side of the spike.

In Example 14, the embodiments of any preceding paragraph or combination thereof further include the annular seal is positioned intermediate the annular grove and the well casing.

In Example 15, the embodiments of any preceding paragraph or combination thereof further include the annular seal comprises a polygon cross-section.

In Example 16, the embodiments of any preceding paragraph or combination thereof further include the annular seal comprises a substantially circular cross-section.

In Example 17, the embodiments of any preceding paragraph or combination thereof further include the annular seal comprises a metamaterial.

In Example 18, the embodiments of any preceding paragraph or combination thereof further include the annular seal comprises a material having a negative or zero coefficient of thermal expansion.

In Example 19, the embodiments of any preceding paragraph or combination thereof further include the annular seal is at least partially compressed by an inner wall of the well casing when the expandable liner hanger is in the expanded state.

In Example 20, the embodiments of any preceding paragraph or combination thereof further include the annular seal extends beyond an outer surface of the spike when the expandable liner hanger is in an initial state prior to being expanded.

In Example 21, the embodiments of any preceding paragraph or combination thereof further include the annular groove comprises a dovetail shape.

In Example 22, the embodiments of any preceding paragraph or combination thereof further include another annular seal extending in an annular ring along the outer perimeter of the expandable liner hanger adjacent to the spike.

Example 23 is a method of performing operations in a subterranean well. The method comprises positioning a liner hanger system within a well casing. The liner hanger system comprises a liner hanger and a spike extending in an annular ring along an outer perimeter of the liner hanger. The spike comprises an annular groove defined therein. The liner hanger system further comprises an annular seal positioned in at least a portion of the annular groove. The method further comprises expanding the liner hanger system from an initial state where the spike is not in contact with the well casing to an expanded state where the spike is in contact with the well casing. The spike and the annular seal are configured to seal an uphole well portion from a downhole well portion when the liner hanger system is in the expanded state.

In Example 24, the embodiments of any preceding paragraph or combination thereof further include the annular groove comprises a dovetail shape and the annular seal comprises a polygon cross-section.

Certain terms are used throughout the description and claims to refer to particular features or components. As one skilled in the art will appreciate, different persons may refer to the same feature or component by different names. This document does not intend to distinguish between components or features that differ in name but not function.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A liner hanger system for use in a subterranean well, wherein the liner hanger system comprises:

a well casing;

a liner having a weight; and a liner hanger comprising:

a spike extending in an annular ring around an outer perimeter of the liner hanger, wherein the spike comprises an annular groove defined therein comprising an undercut portion and a groove cross-sectional area; and an annular seal comprising a material having a negative or zero coefficient of thermal expansion positioned at least partially within the annular groove, the seal comprising a cross-sectional area smaller than the groove cross-sectional area;

wherein the liner hanger is expandable to transition between an initial state where the spike is not in contact with the well casing and the seal is not in the undercut portion and an expanded state where the spike is in contact with the well casing such that the liner hanger supports the weight of the liner in the well and the seal is compressed into the undercut portion of the annular groove; and wherein the spike and the annular seal are configured to seal an uphole well portion from a downhole well portion when the liner hanger is in the expanded state.

2. The liner hanger system of claim 1, wherein the annular seal comprises a polygonal cross-section.

3. The liner hanger system of claim 1, wherein the annular seal comprises a substantially circular cross-section.

4. The liner hanger system of claim 1, wherein the annular seal comprises a metamaterial.

5. The liner hanger system of claim 1, wherein the annular seal comprises a encapsulated lattice structure.

6. The liner hanger system of claim 1, wherein the annular seal is at least partially compressed by an inner wall of the well casing when the liner hanger is in the expanded state.

7. The liner hanger system of claim 1, wherein the annular seal extends beyond an outer surface of the spike when the liner hanger is in the initial state.

8. The liner hanger system of claim 1, wherein the annular groove comprises a dovetail shape.

9. The liner hanger system of claim 1, wherein the liner hanger comprises another annular seal extending in an annular ring around the outer perimeter of the liner hanger adjacent to the spike.

10. The liner hanger system of claim 1, wherein the spike comprises a first spike, wherein the liner hanger further comprises a second spike adjacent the first spike, and wherein the second spike comprises a continuously flat outer surface configured to contact the well casing when the liner hanger is in the expanded state.

11. The liner hanger system of claim 1, the annular seal is compressed and fills a portion of the annular groove when a pressure differential is present across the uphole well portion and the downhole well portion.

12. An expandable liner hanger for use in supporting a weight of a liner within a well casing in a subterranean well, wherein the expandable liner hanger comprises:

a spike extending in an annular ring along an outer perimeter of the expandable liner hanger, wherein the spike comprises an annular groove defined therein comprising an undercut portion and a groove cross-sectional area; and an annular seal comprising a material having a negative or zero coefficient of thermal expansion positioned within at least a portion of the annular groove of the spike, the seal comprising a cross-sectional area smaller than the groove cross-sectional area;

wherein the spike is configured to grippingly engage an inner wall of the well casing when the expandable liner hanger is in an expanded state such that the liner hanger supports the weight of the liner in the well, and wherein the annular seal is configured to be compressed to fill the undercut portion of the annular groove when a pressure differential is present across an uphole well side and a downhole well side of the spike.

13. The expandable liner hanger of claim 12, wherein the annular seal is positioned intermediate the annular grove and the well casing.

14. The expandable liner hanger of claim 12, wherein the annular seal comprises a polygon cross-section.

15. The expandable liner hanger of claim 12, wherein the annular seal comprises a substantially circular cross-section.

16. The expandable liner hanger of claim 12, wherein the annular seal comprises a metamaterial.

17. The expandable liner hanger of claim 12, wherein the annular seal is at least partially compressed by an inner wall of the well casing when the expandable liner hanger is in the expanded state.

18. The expandable liner hanger of claim 12, wherein the annular seal extends beyond an outer surface of the spike when the expandable liner hanger is in an initial state prior to being expanded.

19. The expandable liner hanger of claim 12, wherein the annular groove comprises a dovetail shape.

20. The expandable liner hanger of claim 12, further comprising another annular seal extending in an annular ring along the outer perimeter of the expandable liner hanger adjacent to the spike.

21. A method of performing operations in a subterranean well, wherein the method comprises:

positioning a liner hanger within a well casing, wherein the liner hanger comprises spike extending in an annular ring along an outer perimeter of the liner hanger, wherein the spike comprises an annular groove defined therein comprising an undercut portion and a groove cross-sectional area, and wherein the liner hanger further comprises an annular seal comprising a material having a negative or zero coefficient of thermal expansion positioned in at least a portion of the annular groove, the seal comprising a cross-sectional area smaller than the groove cross-sectional area; and expanding the liner hanger from an initial state where the spike is not in contact with the well casing and the seal is not in the undercut portion to an expanded state where the spike is in contact with the well casing such that the liner hanger supports a weight of the liner in the well and the seal is compressed into the undercut portion of the annular groove, wherein the spike and the annular seal are configured to seal an uphole well portion from a downhole well portion when the liner hanger system is in the expanded state.

22. The method of claim 20, wherein the annular groove comprises a dovetail shape and the annular seal comprises a polygon cross-section.

* * * * *